United States Patent [19]

Sarvay

[11] 3,931,699

[45] Jan. 13, 1976

[54] GLAZING SYSTEM

[75] Inventor: J. Thomas Sarvay, Rush, N.Y.

[73] Assignee: Schlegel Manufacturing Company, Rochester, N.Y.

[22] Filed: May 20, 1974

[21] Appl. No.: 471,323

[52] U.S. Cl. ..... 52/476; 52/403; 49/489

[51] Int. Cl.[2] ..... E06B 3/62

[58] Field of Search ..... 49/489, 440, 441; 52/476, 52/498–502, 397, 403

[56] References Cited

UNITED STATES PATENTS

| | | | |
|---|---|---|---|
| 2,503,887 | 4/1950 | Schlegel | 49/441 X |
| 2,877,515 | 3/1959 | Haas | 52/403 X |
| 3,213,584 | 10/1965 | Bush | 49/489 X |
| 3,295,260 | 1/1967 | Bush et al. | 49/489 |

FOREIGN PATENTS OR APPLICATIONS

| | | | |
|---|---|---|---|
| 1,456,933 | 9/1966 | France | 52/397 |

*Primary Examiner*—Kenneth Downey
*Attorney, Agent, or Firm*—George W. Shaw

[57] ABSTRACT

Interior and exterior glazing strips hold a window glass or panel in place in a structural frame that has an opening slightly larger than the glass or panel. The glazing strips have a resilient reinforcing member with an elastomeric material extruded over and covering the reinforcing member. Receivers for the glazing strips have channels shaped to interlock with and hold the glazing strips around the periphery of the frame, and the reinforcing member extends from the gripping portion of the strip into the base of the strip interlocked with the channel. The reinforcing member resiliently presses the retainer portion of the glazing strip against the window glass or panel with a force of approximately 4–6 pounds per linear inch around the periphery of the window glass or panel.

14 Claims, 9 Drawing Figures

GLAZING SYSTEM

THE INVENTIVE IMPROVEMENT

Many glazing systems have been suggested for window wall assemblies, storefront windows, curtain walls, and other architectural systems using window glass or panels to be secured in place in a structural frame. The frame generally overlaps the glass or panel on the exterior side to prevent the glass or panel from falling outward, and elastomeric glazing strips are secured around the inside of the glass or panel to hold it in the frame. Such constructions suffer from many problems, including deterioration of the glazing strips from age and ultraviolet light degradation and varying characteristics of the glazing strips at different temperatures. These difficulties have led to many serious and expensive problems.

Another problem faced by glazing systems is different kinds of glass and panel materials used in modern buildings. The expansion and contraction and other characteristics of different glass materials vary widely and must be accommodated by glazing systems, and glass can have different thicknesses, can be single glass panes and double glass panes, and panels can be formed of materials other than glass.

In many buildings, window glass is originally installed from the inside against an overlapping frame structure before the building is completed, and if the window glass has to be replaced, it ordinarily must be reinstalled from the inside. This can cause much expense and difficulty when equipment installed after the original window glass was mounted interferes with installation of a replacement window glass.

The invention involves recognition of the many problems encountered by glazing systems and proposes an improved solution to all these problems in a glazing system that is simple, economical, and able to accommodate a wide range of constructions and glass and panel material. The invention aims at a versatile glazing system that can be widely applied to many constructions with a few minor and inexpensive variations. The invention seeks economy, reliability, safety, and long life durability in a glazing system for securely holding a variety of window glass and panels in place. The inventive glazing system also allows replacement of window glass or panels from the exterior of the building after original installation of window glass or panels from the interior of the building.

SUMMARY OF THE INVENTION

The inventive glazing system supports a window glass or a panel in a structural frame having an opening slightly larger than the window glass or panel around the entire periphery of the window glass or panel. An interior and an exterior glazing strip hold the window glass or panel in place in the frame, and each of the glazing strips has a resilient reinforcing member and an elastomeric material extruded over and covering the reinforcing member. The glazing strips have an anchorage base and a retainer portion, and the reinforcing member extends from the retainer portion into the anchorage base. Each of a pair of rigid receivers has a channel shaped to interlock with the anchorage base of one of the glazing strips, and the receivers extend around the periphery of the frame and hold lengths of the glazing strips in place to engage and seal opposite surfaces of the window glass or panel around the periphery of the window glass or panel. The configuration and material of the reinforcing member is selected for resiliently pressing the retainer portion of the glazing strip against the window glass or panel with a force of approximately 4–6 pounds per linear inch around the periphery of the window glass or panel. The anchorage base is insertable into interlocking relation with the receiver and is removable from the receiver only by deliberate force for replacing the window glass or panel.

DRAWINGS

DETAILED DESCRIPTION

Figure 1:
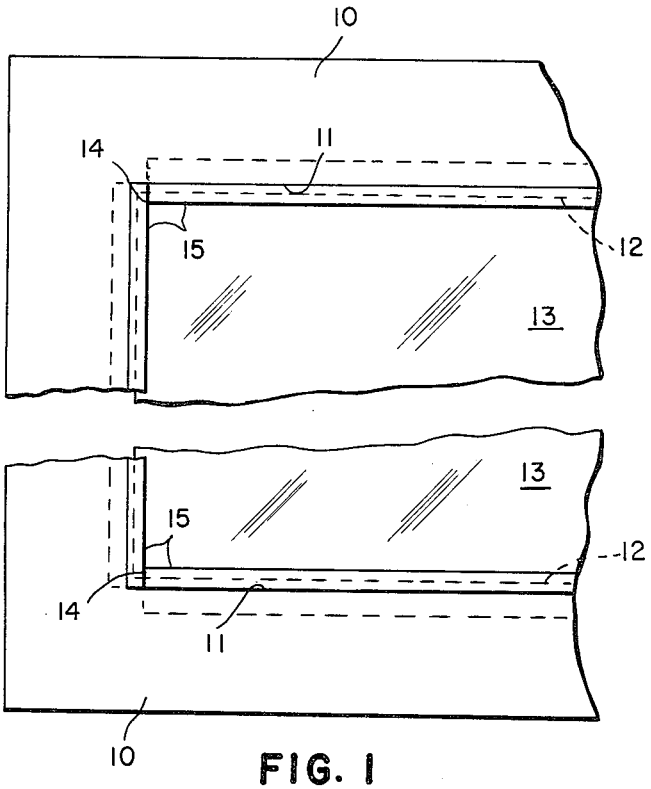
FIG. 1 is a fragmentary, elevational view of a preferred embodiment of the inventive glazing system.

The inventive system uses only internal and external glazing strips to support and seal a window glass or panel in a structural frame, and the frame does not overlap the window glass or panel on either the exterior or interior side. This allows the window glass or panel to be installed from either side of the frame which has an opening slightly larger than the window glass or panel around the entire periphery of the window glass or panel. Thus, as shown in FIG. 1, frame 10 has an opening 11 larger than the perimeter 12 of a pane of window glass 13 mounted in frame 10. Glass 13 is held in place by glazing strips 15 which engage the entire periphery of glass 13 around its exterior and interior sides and are securely mounted in frame 10.

Figure 2:
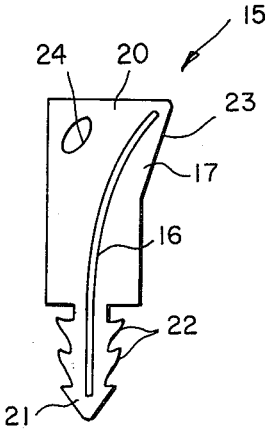
FIG. 2 is an end elevational view of a preferred embodiment of glazing strip for the inventive system.
Figure 3:
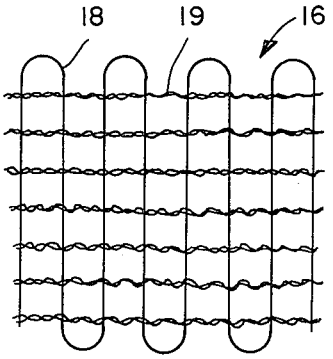
FIG. 3 is a partially schematic, plan view of a preferred embodiment of reinforcing member for the glazing strip of FIG. 2.

FIG. 2 shows one preferred form for glazing strips 15 which include a resilient reinforcing member 16 and an elastomeric covering material 17. Reinforcing member 16 can be formed of various metallic and resin materials to have the desired strength and resiliency characteristics. One preferred reinforcing member 16 is shown in FIG. 3 as formed of zig-zag loops of wire 18 held together by stitching 19. A monofilament of resin material can be substituted for wire 18, and generally the tensile strength and diameter of wire or filament 18 can be selected to provide the desired strength and resilience characteristics for reinforcing member 16. Other materials suitable for reinforcing member 16 include perforated or notched metal strips, springy metal cross strips secured together by stitching, sheet plastic strips, and other materials having the desired characteristics.

Glazing strip 15 is preferably formed in a crosshead extrusion process in which elastomeric covering 17 is extruded over reinforcing member 16, and glazing strips 15 are preferably made in indefinite lengths and later cut to fit a particular frame. Many rubber and rubber-like materials are suitable for elastomeric covering 17, and glazing strips 15 can have many cross-sectional shapes.

Glazing strip 15 includes a retainer portion 20 and an anchorage base 21, and reinforcing member 16 extends from retainer portion 20 down into anchorage base 21 as illustrated. Reinforcing member 16 then provides a strong and resilient connector between retainer portion 20 and base 21. Base 21 has hooks 22 to interlock with a receiver as explained below, and retainer portion 20 has a surface 23 shaped to engage and press against a window glass or panel.

When reinforcing member 16 is formed of zig-zag wire or filament as shown in FIG. 3, the zig-zag pattern of reinforcing member 16 may show through elastomeric covering 17 after the extrusion is finished, and to prevent this from appearing in the final product, an opening 24 can be formed in retainer portion 20 to "absorb" the pattern of reinforcing member 16 and allow glazing strip 15 to have a smooth exterior. Any unevenness in elastomeric material 17 will appear in opening 24 rather than at the exterior of glazing strip 15 for an improvement in appearance. Under some circumstances opening 24 is not necessary or desirable.

Glazing strip 15 can be formed of two different durometers of material 17 such as a relatively firm and rigid base 21 and a softer and more resilient sealing portion 20. This can give strength and security to the anchorage of glazing strip 15 in the frame and also allow a readily deformable and secure elastomeric grip by retainer portion 20 on a window glass or panel.

The strength and resilience of reinforcing member 16 determines the grip of retainer portion 20 on a window glass or panel, and a preferred grip for the inventive glazing system is approximately 4–6 pounds per linear inch around the periphery of a window glass or panel to be held in place. Since the gripping force is set by the strength and resilience of reinforcing member 16, the gripping force remains relatively constant even though elastomeric material 17 ages or deteriorates. This provides a secure grip for a long life and a retaining force that is not practically affected by changes in temperature or in material characteristics as materials age.

Glazing strips 15 are made in indefinite lengths and can be shipped in coil form to a building site where they are cut to length to form butt joints 14 as shown in FIG. 1, or mitre joints or other joints, preferably all of which are sealed. The interior and exterior can be glazed with the same strip to reduce the number of parts required, and the glazing strips can be cut and formed with bonded joints in a completed frame made at the factory and shipped to the building site. Since glazing strips 15 are flexible and resilient, a completed glazing frame can be deformed enough to be pressed into a structural frame at the building site.

Figure 4:
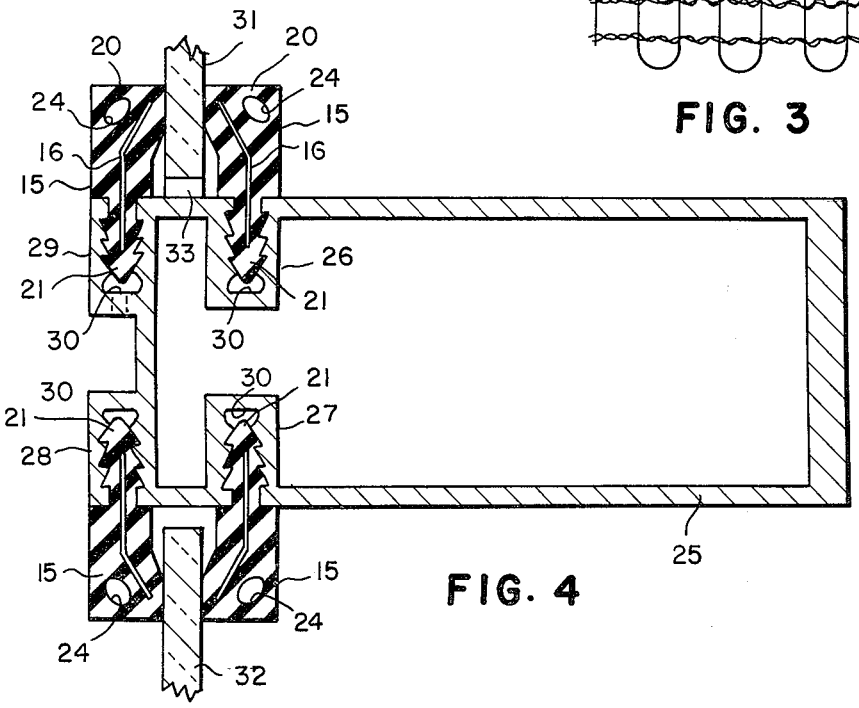
FIGS. 4–9 are fragmentary cross-sectional views of preferred alternative constructions using the inventive glazing system.

Various installations of the inventive glazing system are shown in FIGS. 4–9, and each installation uses receivers holding glazing strips 15 in place. Referring to FIG. 4, structural frame 25 for a building has four receivers 26–29, each having a channel 30 for receiving glazing strips 15. Whatever notch or hook configuration is formed on anchorage base 21 is also preferably formed in complement in channel 30 so that glazing strips 15 can be pressed into a secure interlocking fit in channel 30 as illustrated. Preferably, manual force is sufficient to press base 21 of each glazing strip 15 fully into a tight interlocking fit in each channel 30, and glazing strips 15 cannot be removed from channel 30 except by deliberate force for tearing strips 15 out of channels 30 to replace a window glass or panel.

In the embodiment of FIG. 4, receivers 26–29 differ slightly from each other, and are all preferably formed as an extrusion of frame member 25. Frame 25 can then be formed of aluminum, resin, or other extrudable material, but appropriate receivers can also be formed in other materials in frames around a window glass.

Glazing strips 15 are all identical in the embodiment of FIG. 4 for engaging and gripping window glasses 31 and 32 with the preferred force of approximately 4–6 pounds per linear inch.

The original installation of the inventive glazing system is preferably from the interior. To accomplish this, exterior glazing strips are locked in place around the entire frame, and the frame opening for window glass 31 is clear from the interior to allow glass 31 to be moved outward to seat against the exterior glazing strips. Window glass 31 is then centered within the frame and supported on seating or mounting blocks 33 and properly shimmed and centered. Then interior glazing strips are pressed into place around the frame to hold glass 31 securely in place. If glass 31 has to be replaced, exterior glazing strips 15 can be torn from their mounting channels 30 even though this may destroy the glazing strips. Reinforcing members 16 give glazing strips 15 sufficient strength so that anchorage bases 21 can be torn out of channels 30 without separating from gripping portions 20 if replacement of window glass 31 is necessary. Then a replacement glass is moved into the proper seat in the frame to rest against the interior glazing strips and the exterior glazing strips are pressed in place to mount the replacement glass securely in the frame. Then problems of moving a large window glass into place from the interior of a completed building filled with obstructing equipment can be avoided.

Figure 5:
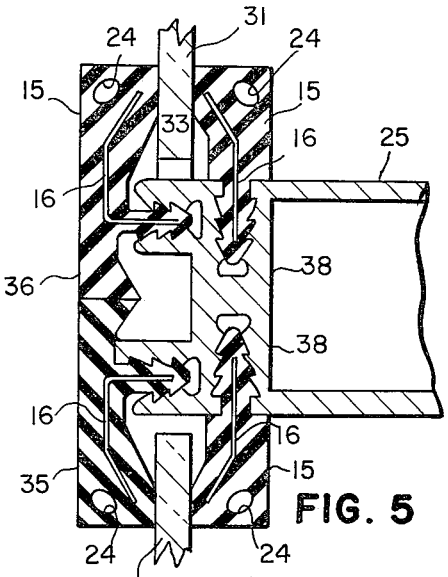

The embodiment of FIG. 5 uses the previously described glazing strips 15 to engage the interior surfaces of glass 31 and panel 34 and uses a pair of mating exterior glazing strips 35 and 36 which abut one another in the finished assembly to provide a thermal barrier between glass 31 and panel 34. Receivers 37 of frame 25 are angled relative to receivers 38 to help accommodate such an arrangement, and the differences between the embodiments of FIGS. 4 and 5 illustrate two of the many variations that can be used in applying the inventive glazing system to various structures.

Figure 6:
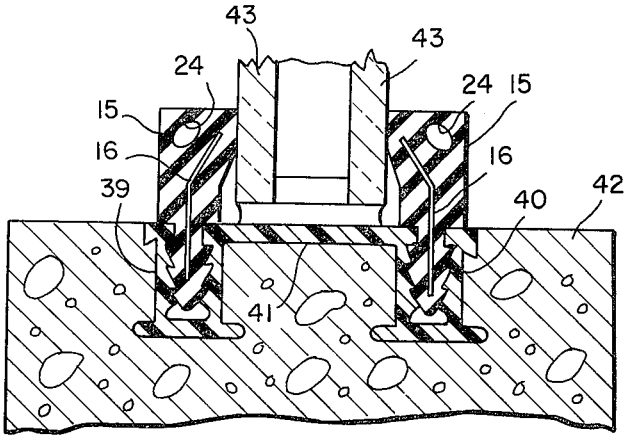
Figure 7:
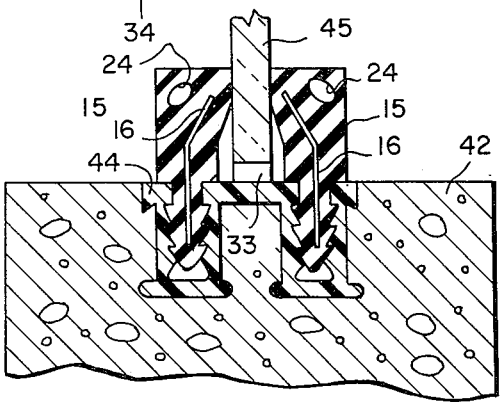

FIG. 6 shows a pair of glazing strips 15 locked in the receivers 39 and 40 of a reglet 41 cast into a concrete frame 42 around a double-pane window glass 43 as illustrated. FIG. 7 shows a similar construction using a narrower reglet 44 so that glazing strips 15 can engage and support a single glass plate 45. Reglets 41 and 44 can be made in various widths to accommodate different thicknesses of window glass or paneling, and reglets can be configured in various ways for a cast interlock with concrete 42. Reglets 41 and 44 are preferably extrusions of resin or metallic material and are preferably hard and rigid relative to glazing strips 15.

Figure 8:
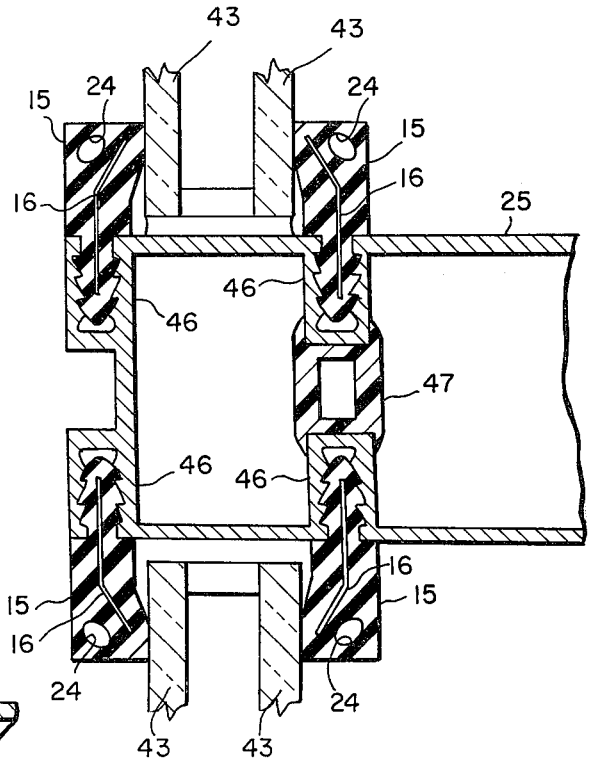
Figure 9:
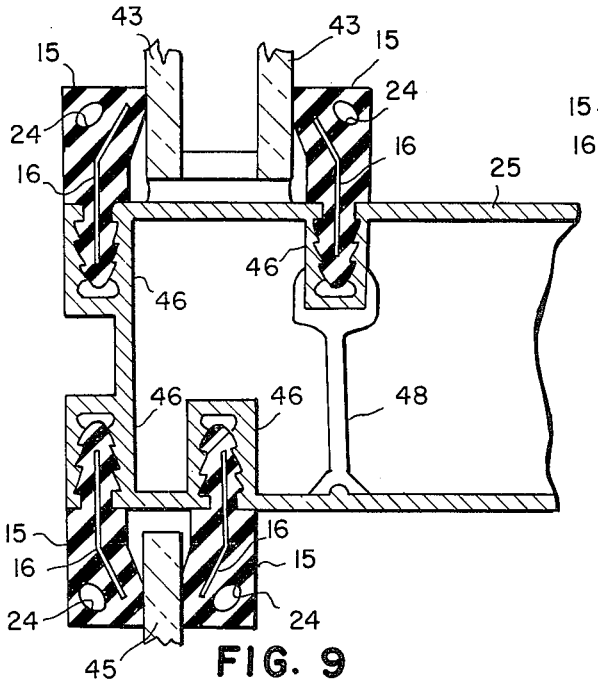

The embodiments of FIGS. 8 and 9 are similar to the embodiment of FIG. 4, but show different spacing of receivers 46 and use of stiffeners 47 and 48 preferably formed of rigid extrusions of resin or metal. Stiffener 47 of FIG. 8 extends between and supports a pair of receivers 46, and stiffener 48 of FIG. 9 supports a receiver 46 relative to a wall of frame 25. FIG. 9 also illustrates that changes can be made between a thickness of glass or paneling in one complete assembly without changing from the basic glazing strip 15 which can be applied in various ways to support many different glass and paneling contructions.

Persons wishing to practice the invention should remember that other embodiments and variations can be adapted to particular circumstances. Even though one point of view is necessarily chosen in describing and defining the invention, this should not inhibit broader or related embodiments going beyond the semantic orientation of this application but falling within the spirit of the invention. For example, those skilled in the art will appreciate the different materials, configurations, and constructions possible in applying the inventive glazing system to various architectural designs.

I claim:

1. A glazing system for a window glass or a panel, said system comprising:

a. a structural frame having an opening slightly larger than said window glass or panel around the entire periphery of said window glass or panel;

b. an interior and an exterior glazing strip holding said window glass or panel in place in said frame;

c. each of said glazing strips having a resilient reinforcing member and an elastomeric material extruded over and covering said reinforcing member;

d. said glazing strips having a single anchorage base and laterally spaced therefrom a retainer-sealing portion, and said reinforcing member extending from said retainer-sealing portion into said anchorage base;

e. a pair of rigid receivers each having a channel shaped to interlock with said anchorage base of one of said glazing strips and extending around the periphery of said frame, lengths of said glazing strips being secured in said receivers to engage and seal opposite surfaces of said window glass or panel around said periphery of said window glass or panel;

f. the configuration and material of said reinforcing member being selected for resiliently pressing and sealing said retainer portion of said glazing strip against window glass or panel with a force of approximately 4–6 pounds per linear inch around said periphery of said window glass or panel; and g. said anchorage base being insertable into said interlocking relation with said receiver and being removable from said receiver only by deliberate force for replacing said window glass or panel.

2. The system of claim 1 wherein said interior and exterior glazing strips are identical.

3. The system of claim 1 wherein said anchorage base and said receiver have a plurality of complementary interlocking hooks.

4. The system of claim 1 wherein said elastomeric material in said retainer-sealing portion has a hollow region between said reinforcing member and the outside of said glazing strip.

5. The system of claim 1 wherein said receivers are formed in a portion of said frame structure.

6. The system of claim 1 wherein said receivers are formed in a reglet cast into said frame structure.

7. The system of claim 1 wherein said elastomeric material of said anchorage base is firmer than said elastomeric material of said retainer-sealing portion.

8. The system of claim 1 wherein said reinforcing member is formed of zig-zag wire with stitching securing the loops of said zig-zag wire together.

9. The system of claim 8 wherein said interior and exterior glazing strips are identical.

10. The system of claim 9 wherein said elastomeric material of said anchorage base is firmer than said elastomeric material of said retainer-sealing portion.

11. The system of claim 10 wherein said elastomeric material in said retainer-sealing portion has a hollow region between said reinforcing member and the outside of said glazing strip.

12. The system of claim 11 wherein said anchorage base and said receiver have a plurality of complementary interlocking hooks.

13. The system of claim 12 wherein said receivers are formed in a portion of said frame structure.

14. The system of claim 12 wherein said receivers are formed in a reglet cast into said frame structure.

* * * * *